United States Patent [19]

Siegal et al.

[11] 4,365,554

[45] Dec. 28, 1982

[54] ARTICLE IMPRINTING APPARATUS

[75] Inventors: Burton L. Siegal; Jay S. Waxman, both of Skokie, Ill.

[73] Assignee: Kiwi Coders Corporation, Wheeling, Ill.

[21] Appl. No.: 200,913

[22] Filed: Oct. 27, 1980

[51] Int. Cl.[3] ..... B41K 1/42

[52] U.S. Cl. ..... 101/333; 101/44; 101/379; 101/DIG. 3

[58] Field of Search ..... 101/334, 333, 41–44, 101/DIG. 3, 35, 379, 380

[56] References Cited

U.S. PATENT DOCUMENTS

| | | | |
|---|---|---|---|
| 1,496,734 | 6/1924 | Pannier, Jr. | 101/380 |
| 3,018,720 | 1/1962 | Nichols | 101/41 |
| 3,168,863 | 2/1965 | McRae | 101/DIG. 3 |
| 3,599,566 | 8/1971 | Fish | 101/333 |
| 3,771,448 | 11/1973 | Sailors, Jr. | 101/334 |
| 3,804,016 | 4/1974 | Marozzi et al. | 101/334 X |
| 4,004,511 | 1/1977 | DeGroot | 101/41 X |
| 4,015,525 | 4/1977 | Shenoha | 101/333 |

*Primary Examiner*—Clifford D. Crowder

*Attorney, Agent, or Firm*—Silverman, Cass & Singer, Ltd.

[57] ABSTRACT

An article marking apparatus of the reciprocable impact type wherein an imprinting head is driven from a rest condition in sealed engagement with an inking cartridge through a ninety degree rotation to impact upon the surface of a passing article whereby to imprint indicia information thereon by means of printing type carried by said imprinting head. The imprinting head is an integral part of a carrier or shuttle device pivotally coupled to a pneumatic drive device by a folding linkage including a drive link supplemented by an idler coupled between the shuttle and the carrier. A guide member is provided in intercepting relation to the shuttle to maintain the shuttle along a preferred path toward a straight line vertical orientation aligned with a window through which the imprint is effected. The inking cartridge is removably mounted within said marking apparatus to intercept the imprinting head carried by said shuttle. A cushioning member is provided to receive the impact of the imprinting head against the ink cartridge. A dished sealing plate also can be provided, along with a resilient gasket adhered to the imprinting head, whereby to achieve a seal between cartridge and imprinting head during the rest condition and to control the impact of the imprinting head upon the article during imprinting. A sensing switch is provided for initiating the imprinting operation and a return switch also is provided for actuating return of the shuttle to place the imprinting head back in the rest condition sealing engaged with the ink cartridge.

18 Claims, 8 Drawing Figures

ARTICLE IMPRINTING APPARATUS

BACKGROUND OF THE INVENTION

This invention relates generally to article imprinting apparatus for imprinting information upon packages, cartons and the like as they travel successively spaced along the reach of a conveyor. More particularly, there is provided an improved impact type reciprocating imprinting apparatus which is more durable and versatile and less costly to fabricate, assemble and maintain than prior devices, which enables the employment of pre-inked ink cartridges and markedly increases the useful life thereof by having means for effecting sealing off of the cartridges during all but the actual imprinting stroke of the apparatus.

In particular, the apparatus provided by the invention includes an imprinting head carrying a biased releasably mounted type holder on which type font can be secured. An effective seal is established between the imprinting head and a disposable inking cartridge to prevent evaporative loss from the cartridge, except during the momentary translation of the head along a path leading to an angularly displaced imprinting location whereat the imprinting is performed. Drive and guide (idler) linkage means are provided to direct the imprinting head along said path in an imprinting stroke and a return stroke to resume the sealed engagement.

Known devices capable of imprinting information upon surfaces of packages, cartons and the like conveyed spaced along a given path along the reach of the conveyor generally are of complex construction with accompanying expense of manufacture, fabrication, assembly and maintenance. Two major types of devices are employed in imprinting indicia on packages and the like. One type of device includes a rotary imprinting wheel on which the type font can be mounted for repeated inking by rotary ink transfer means to which ink is supplied from a source thereof, the imprinting wheel intercepting the article to be imprinted. The second major type of imprinting apparatus involves stamping or impacting inked type face means repeatedly upon successively arriving articles.

The type face means are supplied with ink by impacting the type face means upon an ink saturated pad or the like, usually supplied by some storage means such as cartridge or the like, which include an ink impervious body having a window through which access to the ink impregnated pad is enabled.

The invention herein is concerned with the repeatable impact type imprinting apparatus which involves substantial frequency of required maintenance, and particularly the short life of the inking means employed. Frequent and time-consuming ink cartridge replacement is the rule. One reason for such short cartridge useful life may be attributed to the unusually fast drying character of the ink employed. These highly volatile inks evaporate rapidly, usually depleting the ink pad after only a short time or leaving an inking surface which quickly becomes hard and dry, preventing the normal capillarity effect to resupply the surface of the pad. This phenomenon is encountered where the ink supply takes the form of an ink-saturated absorbent pad disposed within a disposable cartridge having access window means to accommodate the printing head. Often, the skin formed by solvent evaporation is hard whereby ink is unevenly applied to the type font, or at least, is insufficient to effect uniform marking of the package, etc.

During the course of the operation of the imprinting apparatus, the imprinting head is disposed substantially longer at the rest condition, engaged against the inking pad surface. The translation of the imprinting head to the imprinting location and application of the imprint occupies minimal time and requires little exposure of the inking pad. Nevertheless, substantial reduction of the effectiveness of the inking means results since evaporation, etc. occurs while the type holder (carried by the imprinting head) is engaged with the inking pad of the ink storing cartridge.

Seals have been attempted with mixed results. Some attempts have interfered with the inking of the type font while others have been ineffective, failing to establish an effective seal.

It should be noted that the ink-saturated pad is generally resilient because of its saturated condition and the character of the ink absorbent material used to form the pad. The area of engagement of the imprinting head as well as the surface of the head engaging the pad is sometimes so resilient as to fail to establish an effective seal. The type holder seated on the imprinting head and effectively constituting same also is not well suited to make a proper seal with the ink-saturated pad or its surrounding border defining lining member, where provided. Accordingly, rapid evaporation of the fast drying ink still materially reduces the useful life of available cartridges requiring removal of the exhausted cartridge and replacement with a fresh cartridge. Often such premature disabling of the ink supply cartridges occurs many times during a normal (average) imprinting run regardless of the number of articles imprinted.

Another problem encountered with the employment of imprinting apparatus of the type described hereinabove involves the formation of a hard skin formed on the pad as a result of evaporation. The skin prevents transfer of ink from the pad, even though there is substantial ink remaining within the impregnated storing pad. This results in premature removal and replacement of the cartridge long prior to depletion of the ink stored therein.

Still another difficulty encountered with a marking device such as described above involves the means employed to effect the translation of the imprinting head to the imprinting position and return. It is known to employ pivotable arms and the like to mount an imprinting head for repeated movement. Ordinarily, these arms are coupled to a source of dynamic power, such as a fluid operated hydraulic or pneumatic system coupled through a signalling device to a drive arm, in turn secured to an imprinting head and/or to the mounting therefor. Known drives cause the imprinting head to be translated from its rest condition to its angularly displaced position at the imprinting location, so that the imprinting head assumes an orientation with its center line perpendicular to the surface upon which imprinting is to be effected.

It is difficult to maintain the head in the proper path to prevent deviation therefrom during translation to and return from the imprinting location. There has been considerable difficulty in achieving the proper orientation of said imprinting head as well as in controlling the contact pressure exerted by the imprinting head both upon the package surface and upon the ink-saturated pad. Where the contact pressure at impact is too great, smearing and/or other blurring of the imprint would be encountered. Often the imprinting head would be misoriented during its imprinting contact with the package surface, resulting in partial imprints, or imprints carrying too much ink, notwithstanding the fast drying nature of the inks employed. The return stroke often strongly impacts in the relatively soft, yieldable surface of the ink-saturated pad whereby to cause splashing of ink fouling the apparatus, the imprinting head and carrier therefor, and often causing ink to be thrown outward, fouling the ambient surroundings.

Accordingly, it would be highly desirable to prevent the above adverse occurrances in a relatively simply constructed marking apparatus, and to include therein, means to prevent evaporative loss by establishing an effective sealed engagement between the ink cartridge and the printing head during all but the actual imprinting.

Another way of reducing ink loss is to control the impact or contact pressure exercised by the imprinting head (the type face carried thereby) upon the saturated inking pad. Often one had to elect between a contact pressure at impact sufficient to assure proper inking and reduction of contact pressure to prevent splashing of ink.

Control of the quantity of ink applied to the type font during each inking step has been found to be difficult. Too much ink applied to the type will result in smearing of the imprint. Applying too little ink will result in unsatisfactory faint imprints. Additionally, the force of impact upon the surface to be imprinted should be carefully controlled to assure proper, clear and sharply defined imprints. Effecting of such controls as applied to the mechanical drive means is expensive and less than satisfactory.

The translation of the imprinting head between the pair of angularly displaced operating positions should be effected by mechanisms which are relatively simple in construction and are effective to assure proper orientation of the type carried by the imprinting head both on the ink saturated pad during the rest condition, and during the time period when momentarily displaced therefrom to effect application of the imprint. Facility in servicing the imprinting apparatus also is a desirable feature not readily available with known imprinting devices of this type. Particularly, removability of both the inking cartridge and the type holder for replacement, change or reorientation would be highly desirable.

In view of the relative complexity of available imprinting apparatus of the type described, there has been a considerable and long felt need to effect reductions in the costs of fabricating, assembly and maintenance without reduction in efficiency and with achieving increased versatility of the apparatus. It also would be highly desirable to provide a marking apparatus which is versatile and capable of being mounted for operation universally in a plurality of orientations with facility and with efficiency and a minimum of maintenance downtime.

In addition, it would be highly advantageous to provide an intermittent impact reciprocable type imprinting apparatus which is capable of operation at relatively high speed without loss in effectiveness.

SUMMARY OF THE INVENTION

The imprinting apparatus described includes an imprinting head carrying type font seated upon a support member and arranged for displacement between a pair of angularly spaced positions (by a signal controlled drive device, either fluid operated or electrically operated). The imprinting head thus intermittently is displaced from a rest position to an imprinting position at which the type holder momentarily contacts the surface to be imprinted. In the rest position, the head is in sealed engagement with an apertured closure of a pre-inked ink storing cartridge so as to seal the cartridge while the imprinting head is coated with ink from an ink-saturated pad within the cartridge.

The cartridge is yieldably held in position in a mounting disposed in said apparatus so that a desired contact pressure between the imprinting head in its rest position and the saturated pad is maintained so as to effect efficient ink transfer to the imprinting head.

The pre-inked cartridge includes an ink saturated pad seated within an ink impervious housing, usually formed of plastic material. Access is enabled to one side of the cartridge by removal of a cover piece leaving an ink impervious border portion surrounding the window exposed when the cover is removed. The imprinting head is supposed to seat upon the plastic border portion when the head is at the rest position to effect a seal therebetween to control thereby the impact of the printing head upon said ink-saturated pad to reduce the contact pressure at impact which otherwise would cause splash; and further, to prevent excessive impact and contact pressure between the returning imprinting head and the saturated ink pad. Means also are provided to facilitate removal and/or replacement of the type holder of the imprinting head without causing undue downtime of the apparatus. The control of contact pressure is effective for both the inking and the imprinting stages of the imprinting head. Means also to control the impact of the imprinting head are provided so that the imprinting head effects a soft impact with the surface of the ink-saturated pad and with the surface of the article to be imprinted, respectively.

DESCRIPTION OF PREFERRED EMBODIMENTS

Figure 1:
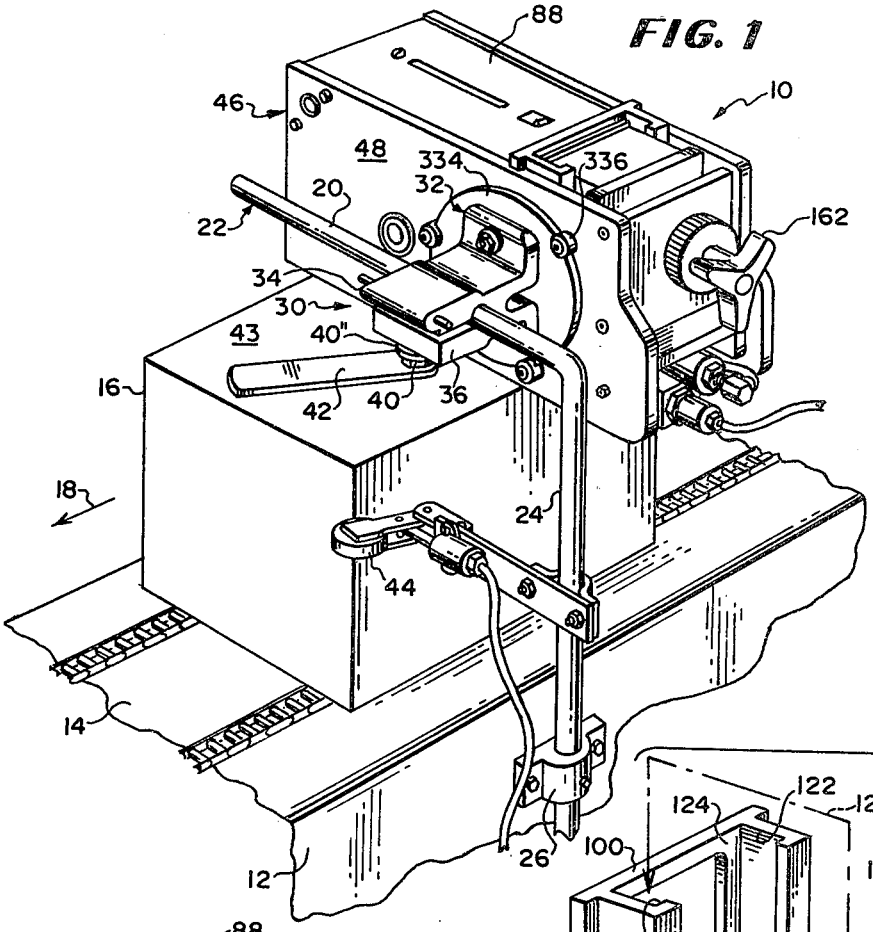
FIG. 1 is a top perspective view of the article imprinting apparatus constructed in accordance with the invention and viewed installed on a conveyor frame in proximity to articles to be imprinted.
Figure 2:
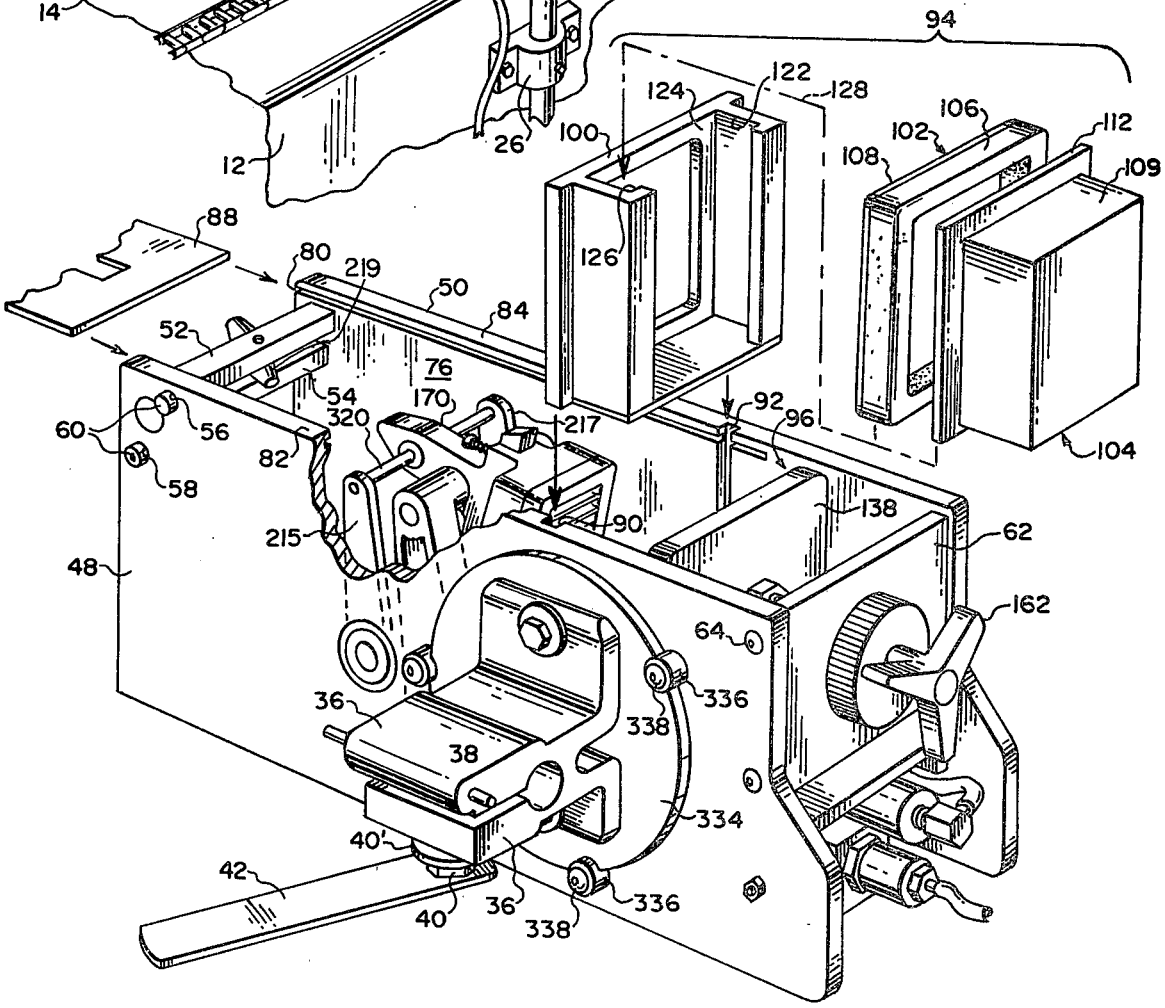
FIG. 2 is an exploded top perspective view of the article imprinting apparatus illustrated in FIG. 1 shown disassembled from the conveyor and in the process of being loaded with an inking cartridge, portions of the apparatus being broken away to show interior detail.

The invention herein provides an intermittent impact type imprinting apparatus for applying imprint information upon a facing surface of packages, cartons, and the like conveyed spaced along a given path along the reach of a conveyor.

An imprinting head is positioned adjustably for intermittent translation between a rest condition sealingly engaged with the surface of an ink saturated medium in the form of a removable pre-inked ink storing cartridge and an angularly spaced imprinting position effected by a signal-controlled pressurized fluid operated drive system so that the imprinting head contacts the surface of the article to be imprinted.

The imprinting head is translated between these two positions by a drive linkage coupled to said fluid operated system and is guided by a secondary linkage functioning as an idler linkage. Both linkages are independently pivotally journalled with the imprinting head to define a folding linkage. The imprinting head includes a shuttle arm carrying shaft means to which the linkages are coupled. The shuttle has a cam-shaped free end and an enlarged head carrying the type means. The free end is adapted to engage an intercepting guide member for assuring that the folding relationship of the link members of the folded linkage is such as to cause the center line of the shuttle to assume a vertically normal orientation ninety degrees from its orientation in the rest condition with the enlarged head end facing the imprinting location.

The enlarged head includes an outwardly opening socket which includes the cavity for receiving the type holder to enable limited biased movement thereof therein. The type holder includes a base lock arrangement for securely holding type elements therein. A resilient gasket may be secured, preferably by adhesive material, to the outer rim of the type holder for cooperating with sealing means surrounding the ink-saturated surface of the inking cartridge whereby to establish a sealing engagement therewith during the period while the imprinting head is at rest position. Means are provided to seat the ink cartridge within the apparatus and adjustably to lock the same therewithin and to exert a controlled adjustable force thereupon.

The seal between the imprinting head and the ink cartridge also can be effected by providing a dished sealing plate or mask assembled with the ink cartridge in the imprinting apparatus. The sealing mask has a window formed therein which is surrounded by an inner rim. The mask is positioned with the inner rim seated closely proximate the exterior facing inking surface of the ink-saturated pad of the cartridge. The type holder that is preferably, the gasket secured to the end of the type holder, engages the inner rim to establish the sealed engagement for the duration the imprinting head is at the rest position (condition) so that no evaporative loss of ink occurs. Effectively, a sealed chamber is formed wherein there is a solvent rich atmosphere about the type enabling the type to remain thereat for a considerable duration without loss due to evaporation. The inking of the type is improved considerably as a result.

The type holder is biased to enable the type holder to fly out inertially from the imprinting head when the latter is stopped in its translation to the rest condition by impacting upon the frame of the ink cartridge assembly, whereby to impact upon the ink saturated surface of the cartridge. Where the sealing mask is employed, the sealing gasket impacts against the inner rim of the mask. The type font elements carried by the base lock means provided on the type holder extend a fraction outward of the sealing surface so that the end surfaces of the type font are coated with sufficient ink yet overloading of the type font with ink is prevented. In addition, splashing of ink upon impact is materially reduced, if not prevented altogether.

Referring now to the drawings for details, the article imprinting apparatus constructed in accordance with the invention herein is designated generally by reference character 10 and is illustrated in FIG. 1, mounted on the frame 12 of a conveyor 14 along which articles 16 travel in a direction indicated by the arrow 18 past said apparatus 10 to enable single imprinting of each with informational indicia.

The apparatus 10 is illustrated mounted on the horizontally oriented arm 20 of bent rod 22, with the vertically oriented arm 24 secured to the frame 12 by clamp 26. Releasable clamp 30 effects the securement of the apparatus 10 to the arm 20 in operating condition and includes a clamping bracket 32 having a pair of generally parallel spaced arms 34 and 36, each including arcuate facing portions 38 to receive the rod arm 20 therebetween. The arms 34 and 36 are capable of being urged together by a capped bolt 40. A captive flat wrench 42 is retained on the capped bolt 40 by a washer 40' and snap ring 40'' secured inward of the capped bolt 40. The wrench 42 functions as a lever which can be utilized to release the rod arm 20 or to clamp same at a location assuring proper location of apparatus 10 for application of an imprint upon the surface 43 of the article 16.

The desired height at which the apparatus 10 is disposed can be fixed by manipulation of the relationship of the rod arm 22 and clamp 26. Rod arm 22 also can carry an actuating lever 44 extending into the path of the article 16 in position to be tripped by the passage of the leading end of the article therepast. The lever 44 is a one-shot actuator as will be described hereinafter and only initiates the imprinting operation, a return switch being incorporated within the apparatus.

The apparatus 10 comprises a housing 46 formed of a pair of mounting plates 48 and 50 which are arranged side by side, spaced apart and connected by transerve corner braces 52 and 54 seated in aligned apertures 56,58 formed in said plates 48 and 50 and secured thereto by screws 60. End wall 62 is secured in position between plates 48 and 50 by screws 64. Transverse brace 66 is secured between said plates 48 and 50 by screws 68 and bottom plate 70 is secured to the brace 66 by screw 72 whereby to define the housing 46.

The inner surfaces 74 and 76 of plates 48 and 50 carry coextensive, aligned, matching, horizontally oriented, facing grooves 78 and 80 parallel and adjacent the upper edges 82 and 84 of said plates 48,50 and extending about two thirds of the total length of said edges. Grooves 78 and 80 open to end 86 of the respective plates 48 and 50 slidably to receive the edges of cover plate 88.

A pair of matching, facing, vertically oriented grooves 90 and 92 are formed in plate surfaces 74 and 76 opening to the upper edges 82 and 84 of said plates 48 and 50. The inking cartridge assembly 94 is received within the housing 46 in chamber 96 defined between the grooves 90 and 92 and the end wall 62 by sliding the assembly 94 in grooves 90 and 92 until the inking cartridge assembly 94 seats on facing stop pins 98 set into said plate surfaces 74 and 76.

The inking cartridge assembly 94 comprises a holding frame 100, a sponge-like rectangular gasket 102 and an ink storing container 104, which is pre-inked and is commercially available. Gasket 102 preferably is formed of a layer 106 formed of spongy material such as a closed-cell foam rubber or the like, and a thin layer 108 formed of ink impervious rubber-like sheet material adhered to layer 106. The container 104 comprises a plastic molded, thin-walled, somewhat resilient box 109 having an entrance 110 and an outer rim 112 coextensive with said entrance 110 and surrounding same, and an inner rim 112'.

An ink-saturated pad 114 is disposed within the interior 116 of the container 104, preferably fully occupying the interior 116 thereof. A sheet liner 118 generally is included across the top of the box to shield and seal off the entrance 110 preventing access to the interior pad 114 until assembly thereof into the cartridge unit 94 is desired. The liner 118 usually is provided with a scored area, removal of which defines a window 120 to enable access to be gained to said ink-saturated pad surface but leaving a bordering portion between the inner rim 112' and the ink-saturated pad 114. The window 120 may be of rectangular, circular or even ovalular configuration, depending upon the perimetric configuration of the imprint to be applied to the surface 44 of article 16 or the overall size and/or configuration of the particular surface 43 say, if the surface comprises a bottle cap or the like (not shown).

The gasket 102 is engaged upon the outer rim 112 of the container 104 and together, slidably are engaged within the frame 100 in the channel 122 defined by inner rim 124 and flanges 126 of said frame, as indicated by the broken line 128. The cartridge assembly 94 now is complete and ready for installation into chamber 96.

Figure 7:
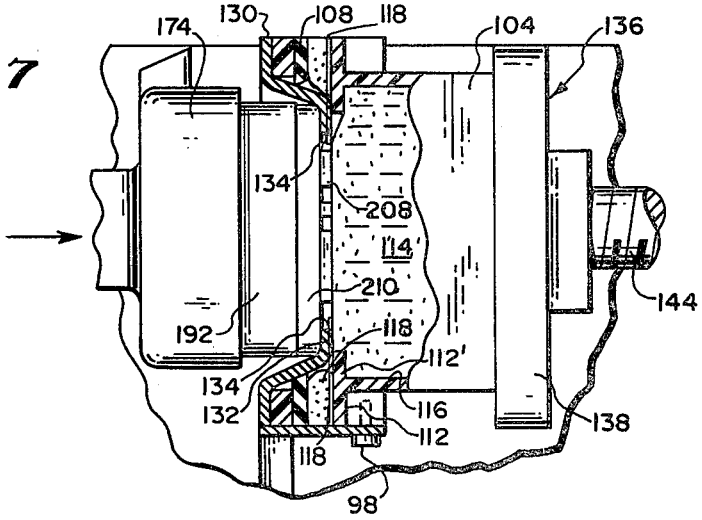
FIG. 7 is a sectional detail similar to that of FIG. 6 but illustrating a modified embodiment of the invention.

Preferably, referring to FIG. 7, a thin plate or mask 130 of generally rectangular dish-shaped configuration is installed along with the cartridge assembly 94 functioning as supplementary sealing means for establishing a sealed engagement between the imprinting head of the apparatus 10 and the ink saturated pad 114 of the cartridge 94.

Mask 130 carries a central recessed floor and a window 134 is formed in the recessed floor, leaving inwardly directed rim portion 132. The mask 130 is seated on the frame holder 100 with the rim portion 132 engaged on the liner portion 118 closely adjacent the ink-saturated pad 114 and coextensively aligned with the window 120. Where the mask 130 is used, it is fitted on the cartridge assembly 94 and both are introduced simultaneously into the chamber 96 by sliding the rim portion 132 and frame 100 into the grooves 90 and 92.

A holding structure 136 for retaining the cartridge assembly 94 in place within the chamber 96 is provided. The holding structure 136 comprises a plate member 138 of generally rectangular configuration carrying a central recess 140 and an aperture 142 formed therewithin. The plate 138 is smaller in area than the end wall 62 and is arranged parallel to the end plate 62. An elongate threaded bolt 144 is received through aperture 142. Washer 146 is placed at the free end 148 of bolt 144 and locked in place by lockwasher 150. A retaining nut 152 is seated on the bolt 144 at the opposite side of plate member 138.

The bolt 144 is threadably engaged through passageway 154 and a retaining washer 156, including small diameter spacer ring 158, are engaged on said bolt 144. The head 160 of the bolt 144 mounts a knob 162 including collar 164. Rotation of the knob 162 will cause the plate to be moved away from the grooves 90 and 92, widening the space between the imprinting head and the plate 88 whereby the inking cartridge assembly 94 can be installed. Once the said inking cartridge assembly 94 has been installed, the plate member 138 can be brought to bear against the container 104. The collar 164 seated on threaded bolt 144 functions to limit the extent of movement of the said plate member 138. Plate member 138 can be moved translated by the manipulation of the knob 162 to facilitate the removal of a spent or exhausted cartridge assembly 94 and in particular, the replacement of an exhausted container 104 with a fresh replacement container.

Attention now will be directed to the imprinting device, designated generally by reference character 170 which is disposed within the housing 46 for movement between a pair of angularly displaced positions, namely, a rest position, whereat a sealed engagement with the ink saturated pad of the inking cartridge assembly 94 is established and an imprinting position along an arcuate path 90° offset from the rest position.

Figure 8:
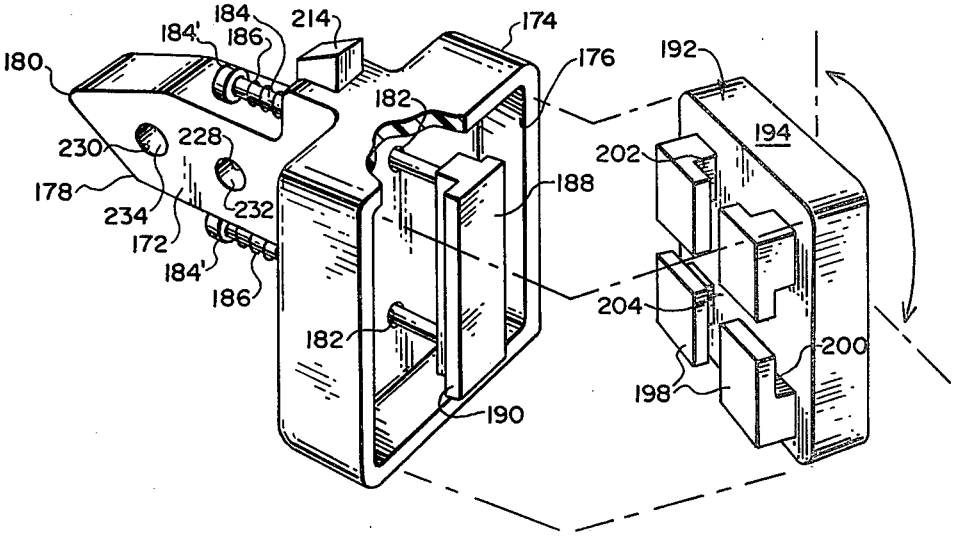
FIG. 8 is a perspective exploded detail representative of the imprinting head and type carrier holder according to the invention illustrating the novel mounting of the holder and the manner of disassembly, thereof.

The imprinting device 170 as a unit comprises an elongate shuttle arm 172 having an enlarged head 174 with an outwardly opening cavity 176 formed therein. The shuttle arm 172 is tapered at its free end 178 to terminate in a rounded cam-like end 180. A pair of parallel passageways 182 are formed through the enlarged head 174 opening to the cavity 176 (as shown in FIG. 8, for example).

Cap bolts 184 carry compression coil springs 186 and are seated in said passageways 182 and terminate secured in the T-bar 188 which has opposite flanges 190 unitary therewith. The dimensions of the passageways 182 and the bolts 184 are selected to permit free movement of the bolts 184 in said passageways while limiting the coil springs 186 disposition between the caps 184' and the enlarged head 174. The T-bar 188 normally is seated within the cavity 176 next adjacent the opening thereof.

Type holder 192 is formed of a generally rectangular hollow block 194 having a rectangular secondary cavity 196 and flanged lug formations 198 extending outward from the surface of the block 194 opposite the cavity 196. The flanged lug formations 198 are arranged to define 90° intersecting T-shaped slots 200 and 202, the intersection being at the center 204. The T-bar 188 can be accommodated in either of slots 200 or 202 whereby to secure the type holder 192 to the enlarged head 174 of the shuttle 172.

A base-lock type support member 206 is seated securely within the cavity 196 of the type holder 192 and carries mounted therein, type font elements 208, there being rows of suitable slots for receiving the base of the type elements. A resilient sealing gasket 210 is adhesively or otherwise secured tightly on the rim 212 of the type holder 192 coextensive with the cavity 196 thereof. The thickness of said gasket 210 is selected to be only slightly less than the outermost extent of the type font elements 208 when they are seated in the base lock element 206. The gasket 210 serves multiple functions, namely, to cushion the shock of impact between the imprinting head 170 and the ink-saturated pad 114 or when provided, the inner rim portion 132 of mask 130. Gasket 210 also functions to cushion the shock of impact between the imprinting head 170 and the surface 44 of the article 16 when imprinting is performed at the end of the imprinting stroke, as will be explained.

When the type font is to be changed or when the orientation of the message also is desired to be changed for different packaging applications, provision is made according to the invention, for facilitating establishment of access to the type holder 192 and is particular for removing the type holder 192 or changing its orientation, reassembling the type holder to the imprinting head 170. The springs 186 are compressed by manipulation of the caps 184' of bolts 184 toward the enlarged head 174. The caps 184' are urged against the bias of said springs 186 until the T-bar 188 is exposed outward of the cavity 176. This extension may be described as a hyper-extension because it is greater than encountered inertially. The type holder 192 can be disengaged easily from the T-bar 188 by sliding the holder 192 therefrom. Replacement of the type holder with one carrying a different type font is performed by sliding the replacement holder onto the T-bar 188. If a 90° change in orientation is desired, the holder 192 is rotated and the T-bar 188 is introduced onto the other intersecting slot. The upstanding lug 214 formed on the enlarged head 174 functions to provide a purchase for the operator in grasping the cap 184' of cap screw 184 and urging the cap 184' against the bias of springs 186. Manipulation of only one of the caps 184' is required to provide clearance sufficient to permit release of the type holder 192.

Attention now is directed to the drive linkage and the guide link cooperating effectively to translate the imprinting head 170 between the angularly spaced positions discussed above. The drive linkage comprises a pair of link members 216 and 218 each having outwardly extending arms 220 and 222 respectively. Socket arms 220 and 222 carry through passageways 224 and 226. The shuttle arm 172 is provided with first and second passageways 228 and 230 in which bushings 232 and 234 are fitted. A shaft 236 is journalled in the bushing 232. Socket arms 220 and 222 are seated on the ends of shaft 236.

Links 216,218 also are provided with enlarged end portions 238,240 carrying first through passageways 242 and 244 respectively located spaced inwardly of the ends 246,248 with the axes of this latter passageway being parallel to passageways 224 and 226. Shaft 250 is mounted through said passageways 242 and 244 with the enlarged portions 238,240 in oppositely facing relationship.

The enlarged end portions 238,240 also are provided with second through passageways 252,254 positioned parallel to first passageways 242,244 and disposed between said first passageways and ends 246,248.

Shaft 256 is accommodated through bushings 258,260 seated in said second passageways with the opposite ends 262,264 thereof seated in bearings 266,268 carried by the housing plates 48,50. The shaft 256 is maintained in fixed relationship within passageways 252,254, in bushings 258,260 of enlarged end portions 238,240 by set screws 269. Lock washers 272 are employed to fix the spacing between portions 238,240 and center the linkage assembly and imprinting head 170 between plates 48,50.

Shaft 250 is provided with a median flat portion 270 carrying transverse passage 273 through which the free end 276 of plunger 278 of cylinder 280 is passed and secured by nuts 282 and 284.

There is a little "play" or looseness provided in the accommodation of said shafts through the respective bushings seated in the respective passageways as related so as to reduce the likelihood of binding during the operation of the apparatus 10.

The drive mechanism for the apparatus 10 is designated generally by reference character 286 and includes a fluid pressure operated cylinder 280 and the plunger 278 movable between fully withdrawn and fully extended conditions within said cylinder 280, a four-way valve 288 coupled between the cylinder 280 and the source of pressurized fluid (not shown). The cylinder 280 is mounted fixedly to a rockable plate 290 provided with depending ears 292 and a depending flange 294. The threaded end 196 of the cylinder 280 is secured to the depending flange 294 of said plate 290.

The four way valve 288 is seated interior of the housing 46 adjacent the bottom plate 70 and is secured to the transverse bottom brace 66. The valve body 298 of valve 288 is arranged generally parallel, and below, the cylinder 280. Valve 288 is coupled to a source of fluid pressure (not shown) by tubing 300 secured to fitting 302. The tubing 304 couples the cylinder 280 to the port 312 of the valve 288 by securement to the fitting 308 of said cylinder 280. The fitting 310 is coupled to another port (not shown) of valve 288. Ball switch 314 is disposed at the end of the valve body 298 opposite the fitting 302.

Figure 3:
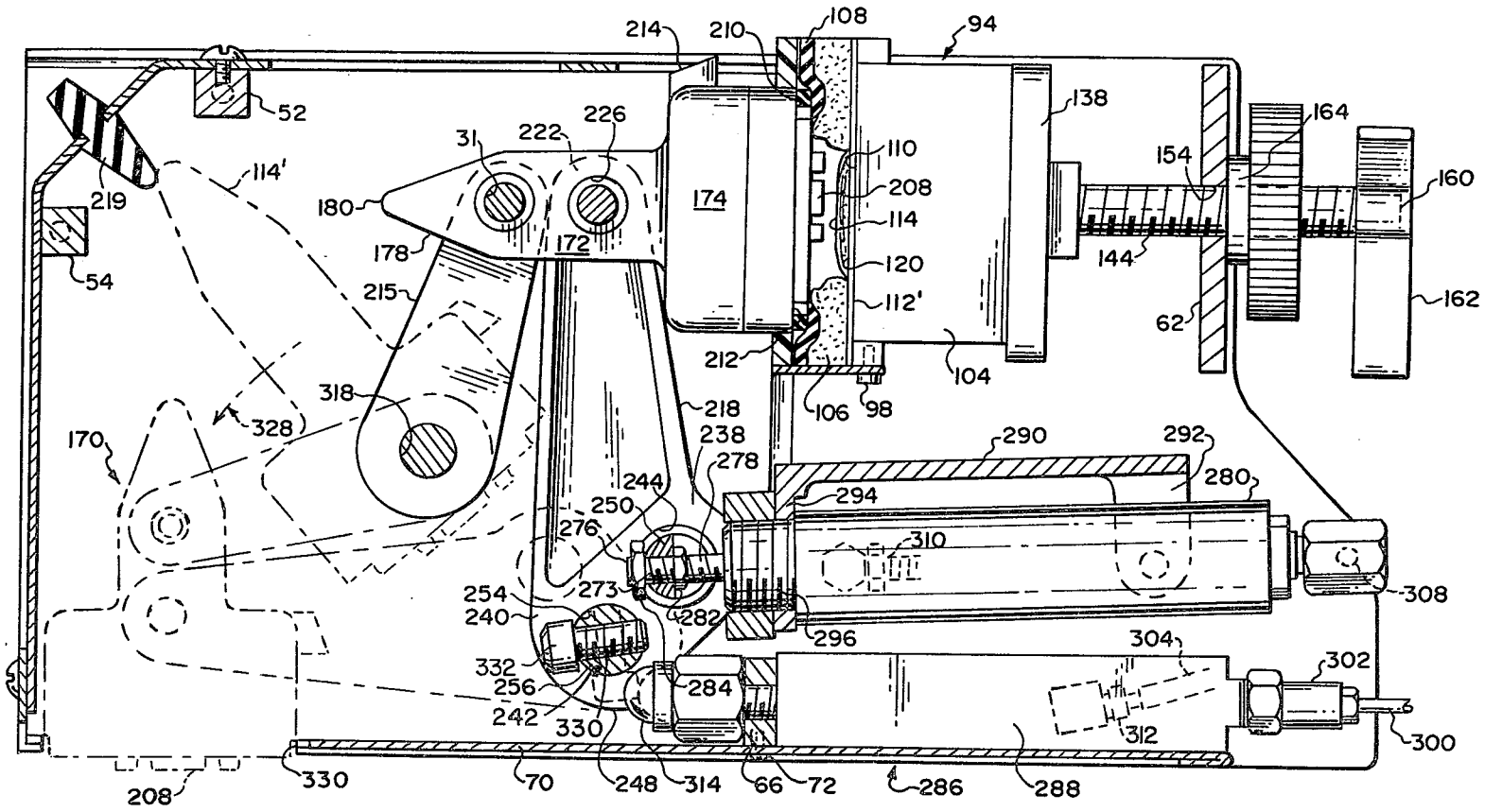
FIG. 3 is an enlarged elevational view of the imprinting apparatus of FIG. 1 with portions deleted and shown partially in section, to show interior details.
Figure 4:
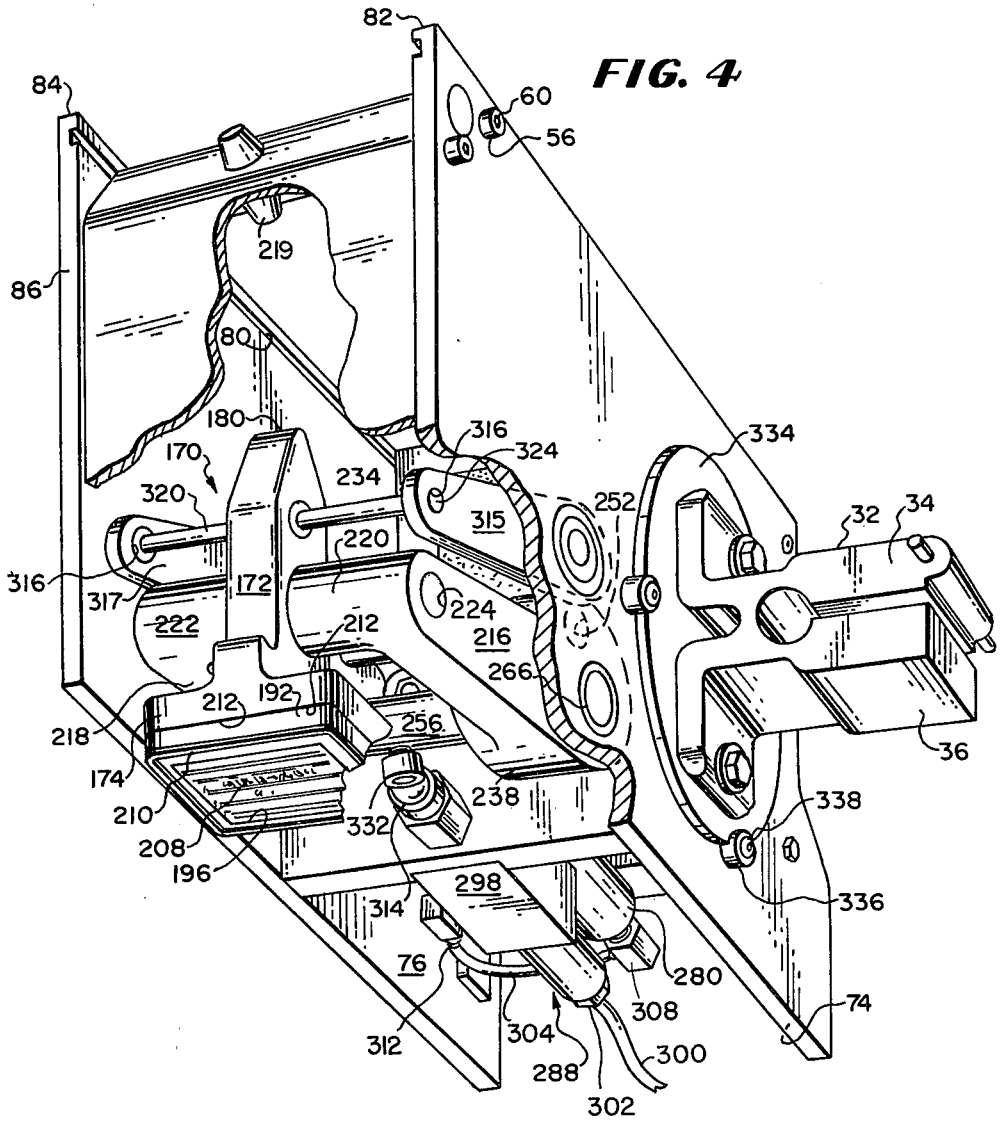
FIG. 4 is a bottom perspective view of the imprinting apparatus illustrated in FIG. 2, portions of same being deleted to show interior detail.
Figure 5:
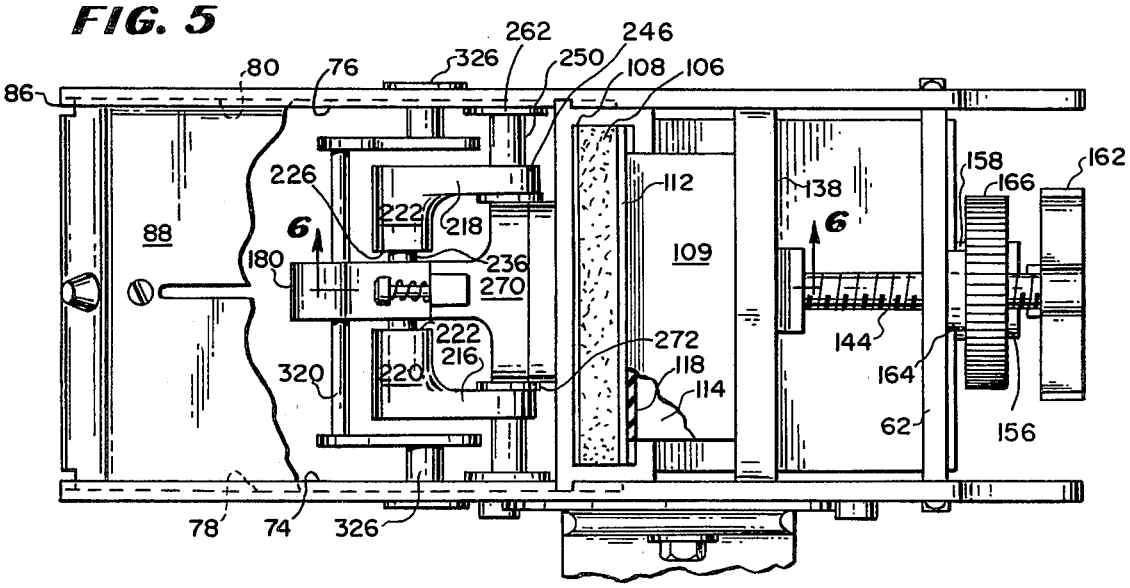
FIG. 5 is a top plan view of the article imprinting apparatus of FIG. 1, portions being broken away to show interior detail.
Figure 6:
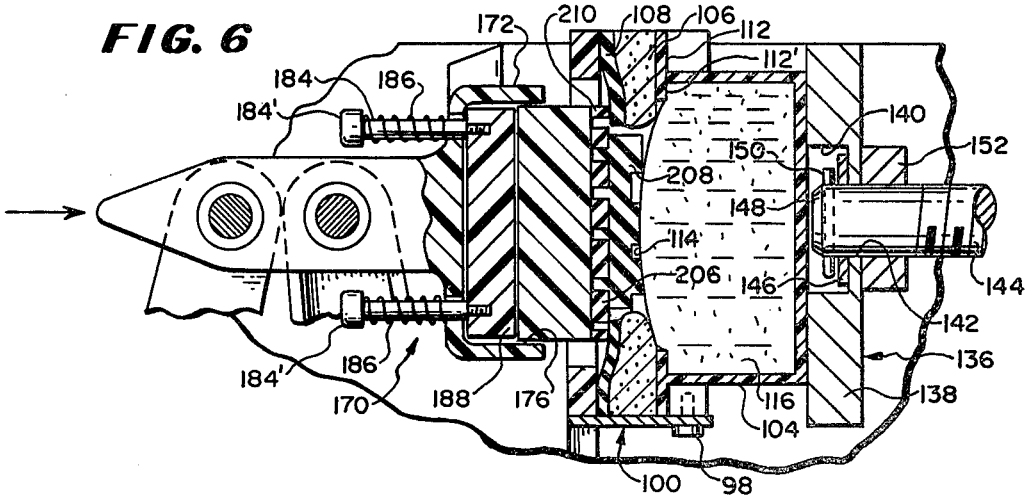
FIG. 6 is a sectional detail taken along lines 6—6 of FIG. 5 viewed in the direction indicated.

In FIG. 3, the ball switch 314 is illustrated in the condition assumed thereby when the imprinting head 170 has returned to its rest condition. As the plunger 278 is driven out of the cylinder 286, the drive link 216,218 is caused to pivot about the axis of shaft 250 through a part of the imprinting stroke until the imprinting head 174 is in the condition represented by the broken line representation 114'.

The guide link 215,217 carries apertures 316 and 318 adjacent opposite ends thereof, the link being journalled on shaft 320 seated in passage defined by bushing 234 in passageway 230, with the shaft ends 322 and 324 seated in aperture 316 and bearings 326 seated in apertures 318, in turn mounted to the plates 48,50.

Referring to FIGS. 1 and 3, the actuating lever 44 disposed in the path of the article 16 is tripped by the leading end of said article 16. The interception of the article 16 by the actuating lever 44 operates the valve 288 to cause fluid pressure to be introduced into the cylinder 280 driving the plunger 278 outward of the cylinder 280. As the plunger 278 is forced outward of the cylinder 280, the shuttle arm 172 is pivoted about shaft 236 directing the shuttle arm 172 along a path represented by an arc 328. As the shuttle arm 172 is forced further toward the corner braces 48 and 50, the arm 172 is forced by guide links 315,317 to assume an angular disposition, bringing end 180 upward until the axes of shafts 256,236,250 and 320 are in a straight line coincident with the center line of the shuttle 172.

At this time, the end 180 of arm 172 is intercepted by the resilient bumper 219 to force said end 180 upward and cause the guide links 215,217 to force the end 180 of said shuttle 172 to pivot upward about shaft 320, bringing enlarged head 174 of printing head 170 directed downward toward, and until, said head 174 assumes a disposition where the center line of the shuttle arm 172 is normal to the window 330 formed in the bottom plate 70. The window 330 has dimensions slightly less than that of the type holder 192 so that the imprinting head 174 will be directed, during imprinting, toward the window 330 and will impact upon said plate 70 surrounding said window 330. The type holder 192 flies out slightly after impact against the sourrounding plate and hence the type engages the surface to be imprinted. The type holder 192 is propelled out of the enlarged end a small distance as an inertial response of sudden cessation of movement. The inked type 208 carried by the type holder 192 is caused therefore, to kiss the surface 43 of the article 16 to be imprinted whereby not to damage same. The resilient gasket 210 absorbs the shock of engagement with the surface 43 and also functions to enable the orientation of type holder 192 to be self-adjusted so as to compensate for minor surface irregularities of surface 43 as well as to compensate for minor height differences so long as the surface 43 to be imprinted is disposed spaced from the imprinting head within the range of extension of said type font 208 carried by the type holder 192.

As the shaft 256 rotates, the bolt head 332 carried thereby, is rotated sufficiently to signal the end of the one-shot imprinting cycle by impinging upon the ball switch 314 when the imprinter head 170 has delivered the imprint. Striking of the ball switch 314 by the bolt head 332 initiates a return movement of the plunger 278 and hence initiates the return stroke to bring the imprinting head 170, and particularly the type holder 192, back to its sealed relationship with cartridge assembly 94.

The clamp 30 is assembled to the apparatus 10 by securement to a circular disc 334 seated on one of the mounting plates 48,50 of housing 46 depending on the side of the conveyor the apparatus is desired to be stationed. The disc 334 is held to the plates 48 or 50 by symmetrically positioned screws 336 carrying slotted washers 338 so that there is a three point coupling. The loosening of said screws 338 enable the apparatus 10 to be rotated to any angular orientation desired, whereupon the screws 33 are tightened. The disc 334 may be removed from the plate 48 and reassembled on the opposite plate 50 if desired.

As viewed in FIG. 1 it is evident that the imprinting apparatus is adjustable for height and overhang, can be installed on either side of the conveyor within appreciable downtime, and can be rotated through any angular disposition relative to the conveyor. The apparatus is versatile, more durable than prior imprinting devices of the intermittent impact type, enables longer useful life for the inking cartridges in view of the improved sealing effect obtained and, as well, includes an improved means for controlling the normal stroke of the imprinting head 170 with added selective hyper-extension to gain access to the type holder 192 for removal and/or replacement thereof, as well as to change its orientation without the use of tools.

The invention is not limited to the use of only fluid operated systems such as described above. Electrically operated devices such as solenoids can be employed to drive the plunger or the linkages whereby to move the imprinting head between its rest and imprinting positions. In lieu of the resilient bumper illustrated and described herein, a corner brace along can be substituted to intercept the shuttle to force the same to move in the desired path for reaching the desired orientation at the imprinting position. Further, a spring finger mounted at the brace or upon the end of the shuttle can suffice to guide the movement of the imprinting head and prevent folding of the linkages causing misalignment of the imprinting head or other interference with the desired shuttle path during the imprinting and/or return strokes. The actuating lever 44 may be replaced by electronically operated sensing means, for example, such as a proximity detector, a photocell, etc. which is activated by the presence of an article at or coming to the imprinting location. Still other variations may be made in the details of construction, size, etc. embodying the invention without departing from the spirit and scope thereof as defined in the appended claims.

What we claim is:

1. In an article imprinting apparatus including imprinting head means carrying type font means for applying an imprint to the surface of an object, the type font means having outwardly facing type face, inking cartridge means having an exposed inking surface adapted to be engaged by said type face means during a rest condition, drive means for translating said imprinting head means between the rest condition and an imprinting position angularly displaced from the inking cartridge means and return and linkage means coupled between said drive means and the imprinting head means for effecting the translation, the improvement comprising said ink cartridge means being mounted immovably in the path of the imprinting head at the rest condition, an outwardly opening cavity in said imprinting head means, type holder means mounted within said cavity, resilient means mounting said type holder means for limited inertial extension of said type holder means outward of said imprinting head means upon abrupt cessation of motion of said imprinting head means at least at the imprinting position, perimetric sealing gasket means secured to said type holder arranged to engage said inking cartridge for establishing a sealed engagement therewith preventing evaporation of the ink therefrom during the rest condition of the imprinting head means, said resilient perimetric sealing gasket means having a bearing face arranged to extend a predetermined distance spaced from the end face level of the type font means to hold same against the surface of the object during momentary impact thereon of said type font means controlling the said impact, and further to self-compensate for surface mis-orientation and irregularities relative thereto assuring proper imprint.

2. The article imprinting apparatus as claimed in claim 1 in which said mounting means comprise a resiliently biased mounting secured within the imprinting head means and means for enabling releasable securement of said mounting to said type holder, said type holder means being capable of being manually extended fully outward of the cavity of the imprinting head means and free of said imprinting head means for removal and for replacement of said type holder.

3. The article imprinting apparatus as claimed in claim 2 in which said last mentioned means comprise slot means defined in said type holder, said slot means being of size and configuration to accommodate said mounting in slidable engagement therewith.

4. The article imprinting apparatus as claimed in claim 1 and sealing mask means engaged over the exposed inking surface of the inking cartridge within the apparatus, said mask means including inner rim means adapted to be engaged by said bearing face of said resilient gasket means of said type holder to establish said sealed engagement therebetween when the imprinting head means returns from its imprinting position to assume the rest condition, said sealed engagement being maintained during the rest condition.

5. The article imprinting apparatus as claimed in claim 4 in which said sealing mask means further include a relatively rigid dished member including inner and outer rims and a window surrounded by said inner rim, said dished member being engaged over the inking cartridge with said inner rim seated closely adjacent the inking surface and the bearing face being engaged against said inner rim.

6. The article imprinting apparatus as claimed in claim 1 and means abruptly stopping translation of the imprinting head means just prior to reaching the imprinting position and means associated with the imprinting head means for effecting said limited inertial extension.

7. The article imprinting apparatus as claimed in claim 1 wherein said drive means comprise fluid pressure operated plunger means, drive and idler linkage means coupled to said imprinting head and to said plunger for selectively moving said imprinting head means between said rest condition and the imprinting position and return and guide means interposed in the path of said imprinting head means for interception thereof for ensuring proper orientation of said imprinting head means at the rest condition and at the imprinting position respectively.

8. The article imprinting apparatus as claimed in claim 7 and sealing mask means engaged over the exposed inking surface of the inking cartridge within the apparatus, said mask means including inner rim means engagable with said resilient gasket means to establish and maintain said sealed engagement in the rest condition.

9. In an article imprinting apparatus including imprinting head means carrying type font means for applying an imprint to the surface of an object, inking cartridge means having an exposed inking surface adapted to be engaged by said type font means during a rest condition, drive means for translating said imprinting head means between the rest condition and an imprinting position angularly displaced from the inking cartridge means and return and linkage means coupled between said drive means and the imprinting head means for effecting the translation, the improvement comprising said imprinting head means comprising type holder means, resilient perimetric sealing gasket means secured to said type holder arranged to engage said inking cartridge whereby to establish a sealed engagement therewith preventing evaporation of the ink therefrom in the rest condition of the imprinting head means, said imprinting head means comprising a shuttle arm having an enlarged head having an outwardly opening cavity formed therein resiliently biased coupling means being seated in said cavity said type holder means being removably seated on said coupling means and disposed within said cavity, the type font being secured within the type holder means for extension a fractional distance outward thereof said resilient sealing gasket means being selected of a thickness less than the said fractional extension of the type font from the type holder means, said coupling means being selectively extensible fully outward of the said cavity to enable removal and replacement of said type holder means.

10. The article imprinting apparatus as claimed in claim 9 wherein said type holder is inertially extensible from the cavity upon abrupt cessation of motion of the imprinting head means.

11. The article imprinting apparatus as claimed in claim 1 and means disposed in the path of the imprinting head means between the rest condition and the imprinting position thereof for preventing undesired folding of said linkage means during translation of said imprinting head means whereby to prevent misdirection of said imprinting head means.

12. The article imprinting apparatus as claimed in claim 11 in which said last mentioned means comprise resilient means disposed within said apparatus in the intercepting relation with a portion of said imprinting head means, said portion being located opposed to the location of the type holder means.

13. The article imprinting apparatus as claimed in claim 12 in which said resilient means comprise a resilient bumper mounted at said intercepting location.

14. The article imprinting apparatus as claimed in claim 11 in which said last mentioned means comprise brace means arranged fixedly to intercept a portion of the imprinting head means, said portion being spaced from the type holder means carried thereby.

15. The article imprinting apparatus as claimed in claim 1 and trip means carried by said linkage means and switch means coupled to said drive means and arranged for actuation by said trip means to effect the return of the imprinting head means to the rest condition thereof subsequent to application of the imprint to the surface of the object.

16. In an article imprinting apparatus including imprinting head means carrying type font means for applying an imprint to the surface of an object, inking cartridge means having an exposed inking surface adapted to be engaged by said type font means during a rest condition, drive means for translating said imprinting head means between the rest condition and an imprinting position angularly displaced from the inking cartridge means and return and linkage means coupled between said drive means and the imprinting head means for effecting the translation, the improvement wherein said imprinting head means includes type holder means, resilient perimetric sealing gasket means secured to said type holder means arranged to engage said inking cartridge for establishing a sealed engagement therewith preventing evaporation of the ink therefrom during the rest condition of the imprinting head means, sealing mask means engaged over the exposed inking surface of the inking cartridge within the apparatus and including a relatively rigid dished member including inner and outer rims, and a window defined by said inner rim and being engaged over the inking cartridge to seat said inner rim closely adjacent the inking surface, said inner rim adapted to be engaged by said resilient gasket means at the terminus of the return of the imprinting head means to assume the rest condition for effecting and maintaining the sealed engagement during the rest condition, means abruptly to stop translation of the imprinting head means at the imprinting position, means associated with the imprinting head means and coupled to the type holder to permit limited inertial extension of the type holder from the imprinting head means to enable engagement of the type carried thereby upon the surface to be imprinted and said coupling means comprise a T-shaped bar member mounted resiliently within said cavity and said type holder means including means defining a pair of undercut intersecting slots each having a configuration capable of accommodating said T-shaped bar member.

17. The article imprinting apparatus as claimed in claim 1 in which the linkage means comprise a drive link arrangement pivotally secured to the imprinting head means and to a fluid pressure operated plunger, an idler link pivotally secured at one end thereof to said imprinting head means at a location adjacent the securement of said drive link arrangement thereto, stationary means within the apparatus for pivotally mounting the other end of the idler link and secondary pivot means coupled to said drive link arrangement offset from the pivotal coupling thereto of said plunger, said drive link arrangement being actuatable by said plunger for effecting pivotal movement about said secondary pivot means simultaneously with pivotal movement of the idler link.

18. The article imprinting apparatus as claimed in claim 14 in which said resilient means comprise a bumper mounted on said brace means.

* * * * *